United States Patent [19]

Babington

[11] Patent Number: 4,507,076

[45] Date of Patent: Mar. 26, 1985

[54] ATOMIZATION APPARATUS AND METHOD FOR LIQUID FUEL BURNERS AND LIQUID ATOMIZERS

[75] Inventor: Robert S. Babington, McLean, Va.

[73] Assignee: Owens-Illinois, Inc., Toledo, Ohio

[21] Appl. No.: 476,454

[22] Filed: Mar. 17, 1983

[51] Int. Cl.[3] ..... F23D 11/28

[52] U.S. Cl. ..... 431/117; 431/190; 431/346; 239/288; 239/427.3

[58] Field of Search ..... 431/346, 350, 3, 29, 431/30, 181, 190, 117; 239/433, 434, 75, 427.3, 427.5, 288, 288.3, 288.5

[56] References Cited

U.S. PATENT DOCUMENTS

| | | | |
|---|---|---|---|
| 1,535,886 | 4/1925 | Zulver | 239/427.5 |
| 2,312,559 | 3/1943 | Klockau | 239/433 |
| 2,781,830 | 2/1957 | Cassidy | 431/30 |
| 4,155,700 | 5/1979 | Babington | 431/117 |

FOREIGN PATENT DOCUMENTS

| | | | |
|---|---|---|---|
| 2410141 | 9/1975 | Fed. Rep. of Germany | 431/190 |
| 256958 | 9/1948 | Switzerland | 431/118 |

*Primary Examiner*—Samuel Scott
*Assistant Examiner*—Noah Kamen
*Attorney, Agent, or Firm*—Pollock, Vande Sande & Priddy

[57] ABSTRACT

An improved apparatus and method for burning liquid fuel or atomizing liquid are disclosed for use in fuel burners or atomizers of the type which comprise a hollow atomizer bulb (20) having a smooth, preferably convex exterior surface (22) which tapers toward a small aperture (14) through which high pressure air or other gas is forced to atomize liquid as it flows in a thin film over the exterior surface of the bulb. Such atomizer bulbs are located within an atomizing chamber (12) through which a flow of air or other gas is directed toward a discharge opening (16,16') aligned with the aperture (24) of the atomizer bulb. To protect the thin film of liquid flowing over the exterior surface of the bulb, the bulb is enclosed within a shield (54–64) which also permits the atomizer bulb to be located closer to the discharge opening (16,16') so that the flame front (F) is positioned in the flame tube (48) rather than in the discharge opening.

49 Claims, 7 Drawing Figures

ATOMIZATION APPARATUS AND METHOD FOR LIQUID FUEL BURNERS AND LIQUID ATOMIZERS

CROSS-REFERENCE TO RELATED APPLICATIONS

The present application is related to three other applications filed concurrently and entitled Improved Liquid Delivery Apparatus and Method for Liquid Fuel Burners and Liquid Atomizers, Ser. No. 476,453; and Flow Control Module and Method for Liquid Fuel Burners and Liquid Atomizers, Ser. Nos. 476,292 and 476,455.

TECHNICAL FIELD

The present invention concerns liquid fuel burners and liquid atomizers and methods of operating such burners and atomizers. The apparatus and method of the invention are particularly related to liquid fuel burners and liquid atomizers of the type which incorporate an atomizer bulb having a smooth, convex exterior surface tapering toward an aperture. A flow of air or other gas is directed through the aperture to atomize the fuel or other liquid as it flows in a thin film over the exterior surface of the atomizer bulb.

BACKGROUND ART

In January 1969, U.S. Pat. Nos. 3,421,692; 3,421,699 and 3,425,058 issued to Robert S. Babington, the present applicant, and his co-inventors. These patents disclose a type of liquid atomization apparatus which is particularly useful in liquid fuel burners. The principle involved in the apparatus, now frequently referred to as the "Babington principle," is that of preparing a liquid for atomization by causing it to spread out in a free-flowing thin film over the exterior surface of a plenum having an exterior wall which defines an atomizer bulb and contains at least one aperture. When gas is introduced into the plenum, it escapes through the aperture and thereby creates a very uniform spray of small liquid particles. By varying the number of apertures, the configuration of the apertures, the shape and characteristic of the surface, the velocity and amount of liquid supplied to the surface, and by controlling the gas pressure within the plenum, the quantity and quality of the resultant spray can be adjusted as desired for a particular burner application. Various arrangements of such atomization apparatus have been disclosed in other U.S. patents issued to the present applicant, namely U.S. Pat. Nos. 3,751,210; 3,864,326; 4,155,700; and 4,298,338. The disclosures of the patents mentioned in this paragraph are specifically incorporated by reference into this application.

FIG. 1 of this application illustrates a liquid fuel atomizing apparatus of the general type disclosed in the previously mentioned patents, which operates in accordance with the Babington principle. An enclosed housing 10, typically cylindrical in configuration, defines an atomizing chamber 12 having a front or dividing wall 14 through which passes a conical discharge opening or discharge cone 16. Housing 10 also includes a back wall 18 from which is supported an atomizer bulb 20 comprising an enveloping exterior wall 22 which defines an internal plenum (not illustrated) and tapers toward a frontal aperture 24. In a typical prior art application in which atomizer bulb 20 comprises a spherical tip of approximately 12.7 mm (0.500 inch) diameter, aperture 24 was spaced approximately 6.35 mm (0.250 inch) from the front exit face of discharge cone 16. In such an example, the inlet diameter of cone 16 was approximately 20.83 mm (0.820 inch) and the outlet diameter was approximately 14.73 mm (0.580 inch).

A source 26 of high pressure air is connected to the plenum defined by exterior wall 22 by means of a conduit 28 so that in operation a flow of air is caused to pass through aperture 24. Positioned above atomizer bulb 20 is a liquid fuel feed tube 30 which in the past has had a circular cross-section but may also have other cross-sections without departing from the scope of the present invention. Liquid fuel drawn from a sump 32 through a conduit 34 by a pump 36 is caused to flow through a further conduit 38 into feed tube 30. From there, the fuel flows over atomizer bulb 20 and forms a film of liquid which completely covers the surface of bulb 20. Of the fuel flowing over the surface of the atomizer bulb, that portion which is not atomized flows from the lower side of bulb 20 as a stream 40 which is directed back to sump 32 through conduit 42, as illustrated. As air flows through aperture 24, the film of liquid continuously forming at the aperture is continuously broken into tiny droplets of liquid which move away in the form of a fine, essentially conical spray 44 of atomized fuel.

In such prior art systems, spray 44 includes some stray or satellite droplets which diverge from the conical flow path illustrated. As a result, the conical wall of discharge cone 16 tends to become wetted and a small amount of liquid fuel flows backward into atomizing chamber 12 and also returns to sump 32 via conduit 42. To complete the schematic illustration of such a prior art fuel burner, FIG. 1 also shows an ignition control 45 and an igniter 46, the latter being located at the outer periphery of spray 44 at a downstream location in order to ignite the fuel in a manner described more completely in the previously-mentioned patents. Ignition of the fuel thus occurs within a flame tube 48, a greatly shortened version of which is shown in FIG. 1.

In order to minimize the possibility that combustion might occur within atomizing chamber 12, a condition known as "burn-back," it is known to provide a flow of air at a pressure slightly greater than atmospheric into chamber 12, past atomizer bulb 20 and through discharge cone 16 along with spray 44. A pair of openings 50 may be used to provide this flow of air usually from a blower that operates at substantially less pressure than high pressure source 26 which supplies air to atomizer 20. In such a prior art apparatus, the flame front F, that is, the point at which a flame is first visible, sometimes has been observed at a point within discharge cone 16, as illustrated.

While this type of prior art liquid fuel burner has been shown to be a practical and efficient burner for domestic and industrial use, some problems, or what have been perceived as problems, have continued to exist. Concern has arisen on the part of some that under particularly adverse conditions, burn-back into atomizing chamber 12 might yet occur. For example, if the pressure and hence the flow of air through atomizer bulb 20 were to decrease in conjunction with insufficient ventilation of chamber 12, flame front F might actually move within atomizing chamber 12, a condition which might lead to burn-back during operation or just after shutdown. A sudden reduction or total cessation of the flow of air flow through conduits 50 as might be experienced if the blower inlet were accidentally closed, might also result in a burn-back situation. Since a portion of the fuel used in these burners is continuously recirculated, burn-back might cause the temperature of the fuel to increase to levels above the flash point. Also, pressure surges in flame tube 48, caused for example by downdrafts in the chimney of a domestic furnace, have been suggested as a possible cause of burn-back into atomizing chamber 12, especially if such a downdraft were to occur at the same time as the aforementioned irregularities.

The flow of pressurized air through conduits 50 into atomizing chamber 12 has been recognized for some time as a means for combatting these potential causes of burn-back. The flow through the atomizing chamber helps to reduce the temperature of the fuel, satisfies the entrainment needs of the high velocity jet of air issuing from aperture 24, promotes mixing of fuel and air and also tends to promote a more controllable location for flame front F. These entrainment needs arise because the jet of air and liquid produces a zone of reduced pressure just outside aperture 24. Without the flow of air through conduits 50, part of which is entrained at the zone of reduced pressure, air or combustion products would be drawn backward from flame tube 48 into atomizing chamber 12 to the zone of reduced pressure, thereby interfering with the formation of spray 44 and increasing the likelihood of burnback. However, as the velocity of air flowing over atomizer bulb 20 increases in such prior art burners, ripples and other flow irregularities can occur in the film flowing over the atomizer bulb, which can result in undesirable carry-over of raw fuel into flame tube 48, or irregular atomizing producing large droplets, or both. It is also thought that some fuel may be torn from stream 40 and carried into flame tube 48 when the airflow through the atomizing chamber is too high. In an effort to control the velocity of the air passing over the tip of atomizer bulb 20, the tip of the bulb has been spaced as much as 6.35 mm (0.250 inch) from the exit face of discharge cone 16, as indicated previously. However, care has been taken not to move the tip of the bulb so far from the discharge cone that flame front F moves into the atomizing chamber, or excessive fuel impinges on the walls of cone 16.

So that such prior art liquid fuel burners and liquid atomizers can have the widest possible range of applications, another continuing problem has been to provide the maximum possible variation in the volumetric flow rate of the atomized fuel or other liquid in spray 44 between the lowest and highest flow rates required. For example, flow rates as low as 0.3785 liter (0.1 gallon) per hour may be required for some applications and as high as 3.785 liters (1.0 gallon) per hour may be required for others.

Once the particular geometry for a given prior art atomizer apparatus has been selected, however, changes in the flow rate of the atomized liquid in spray 44 must be made primarily by adjusting the flow rate of liquid onto the atomizer bulb. For the lowest rates desired, the liquid film thickness at the aperture preferably would be the thinnest achievable while still maintaining a continuous film over the exterior surface of the atomizer bulb. On the other hand, to provide higher flow rates of the atomized liquid, it is necessary to increase the thickness of the film at the aperture without increasing it so much that undesirably large liquid droplets are formed.

In prior art atomizers of the type shown in FIG. 1, a single liquid feed tube has been positioned above each atomizer bulb at a distance of approximately 3.175 to 9.25 mm (0.125 to 0.375 inch) so that a variable flow rate of atomized fuel from about 0.757 to 2.271 liters (0.2 to about 0.6 gallon) per hour has been achievable. In such a case, approximately 0.56 to 0.7 cu.m./m (20 to 25 cfm) is needed for combustion air in flame tube 48. About 10% of this amount is aspirated by the jet pump action of the atomizer bulb. Due to the presence of a relatively high velocity of air over the surface of atomizer bulb 20, which could be as high as 9.14 to 10.67 m/sec (30 to 35 ft/sec), the achievement of significantly thinner or thicker films on the atomizing bulb has been difficult without undesirable ripples in the film. Various applications have remained, however, in which atomized liquid flow rates above and below the range previously mentioned have been desired but have not been reliably achievable.

DISCLOSURE OF THE INVENTION

A primary object of the present invention is to provide an improved liquid fuel burner and liquid atomizer and an improved method of operating such a burner or atomizer which minimize any tendency for burn-back from the flame tube into the atomizing chamber.

Another object of the present invention is to provide such a liquid fuel burner, liquid atomizer and method in which a substantial increase is achieved in the ratio between the maximum and minimum flow rates of atomized fuel or other liquid.

Still another object of the present invention is to provide such a liquid fuel burner, liquid atomizer and method in which the generation of stray or satellite droplets of liquid is minimized, in order to avoid carbonization and varnishing of burner parts.

A still further object of the invention is to provide such a liquid fuel burner and method in which carry-over of raw fuel into the flame tube is minimized, whereby the efficiency of the burner and method is improved.

Yet another object of the invention is to provide such a liquid fuel burner and method in which the liquid film flowing over the atomizer bulb and the return stream flowing from the bottom of the bulb are rendered less sensitive to the flow of air through the atomizing chamber, than in prior art devices and methods.

Another object of the invention is to provide such a liquid fuel burner and method in which the temperature of the liquid fuel flowing over the atomizer bulb is significantly reduced during operation.

These objects of the invention are given only by way of example. Thus, other desirable objectives and advantages inherently achieved by the disclosed invention may occur or become apparent to those skilled in the art. Nonetheless, the scope of the invention is to be limited only by the appended claims.

An improved liquid fuel burner or atomizer according to the present invention comprises a first source of liquid fuel or other liquid, a second source of pressurized air or other gas and at least one enclosed plenum having a smooth, exterior surface with an aperture opening from the plenum through the surface. Means are provided for directing a flow of liquid from the first source onto the exterior surface, whereby a thin film of liquid is formed on the surface and at the aperture. Means also are provided for directing a flow of pressurized gas from the second source into the at least one enclosed plenum and through the aperture to atomize liquid flowing over the aperture and form a spray of tiny droplets. Finally, a shield means is provided which at least partially surrounds the at least one enclosed plenum for protecting the thin film from ambient gas currents and radiant heat, the shield being spaced from the exterior surface to permit free flow of the thin film over the surface. The shield means comprises a first opening aligned with the aperture through which atomized liquid and gas can flow. Those skilled in the art will appreciate that the previously described structure can be used for atomizing various types of liquids in addition to liquid fuels. Where liquid fuels are involved, however, the invention also includes a means for igniting the atomized fuel. In burners of this type, the sprays from two enclosed plenums may be used, in which case the axes of the sprays preferably converge.

Since only a portion of the liquid flowing over the exterior surface of the enclosed plenum is actually atomized, the shield means also comprises an opening through which liquid not atomized can flow from the space between the shield means and the exterior surface. The plenum and shield means are enclosed within an atomizing chamber. Means for directing a further flow of pressurized air through the atomization chamber are provided, along with a discharge opening in one wall of the atomizing chamber at a location aligned with the opening in the shield means and the atomizer aperture, to permit flow of atomized liquid and air from the atomizing chamber. Means are provided for minimizing contact between the liquid not atomized and the air rushing through the atomizing chamber. The means for igniting is located outside the atomizing chamber. The discharge opening of the atomizing chamber preferably is spaced from the atomizer aperture such that the flame front of the burning fuel remains on the opposite side of the discharge opening from the atomizing chamber.

In accordance with the method according to the invention, a first source of liquid fuel or other liquid to be atomized and a second source of pressurized air or other gas are provided. An enclosed plenum is provided having a smooth exterior surface with at least one atomizer aperture opening from the plenum through this surface. A flow of liquid is directed from the first source onto the exterior surface, whereby a thin film is formed on this surface and at the aperture. A flow of pressurized gas is directed from the second source into the plenum and through the aperture to atomize that portion of the liquid flowing over the aperture. Simultaneously, at least a partial shield is provided around the plenum to protect the thin film from ambient gas currents and radiant heat, while permitting free flow of the film over the surface, the shield being provided with an opening through which atomized liquid and gas can flow. Any liquid not atomized at the aperture is removed from the space between the shield and the exterior surface. Preferably, the plenum is enclosed within an atomizing chamber through which a further flow of pressurized gas is directed during operation. When combustion of the atomized fuel is to be terminated, the flow of air through the plenum is stopped while the flow of air through the atomizing chamber and the flow of fuel onto the exterior surface are continued, whereby the plenum, shield, fuel and atomizing chamber are cooled and the potential for burn-back into the atomizing chamber is reduced, following termination of combustion.

BEST MODE FOR CARRYING OUT THE INVENTION

Figure 1:
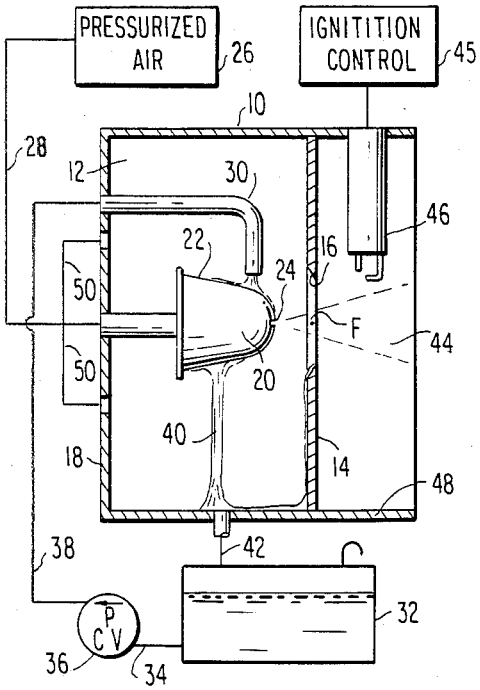
FIG. 1 PRIOR ART
FIG. 1 shows a schematic elevation view, partially in section, of a prior art liquid fuel burner which operates in accordance with the Babington principle.

The following is a detailed description of several preferred embodiments of the invention, reference being made to the drawings in which like reference numerals identify like elements of structure in each of the Figures.

Figure 2:
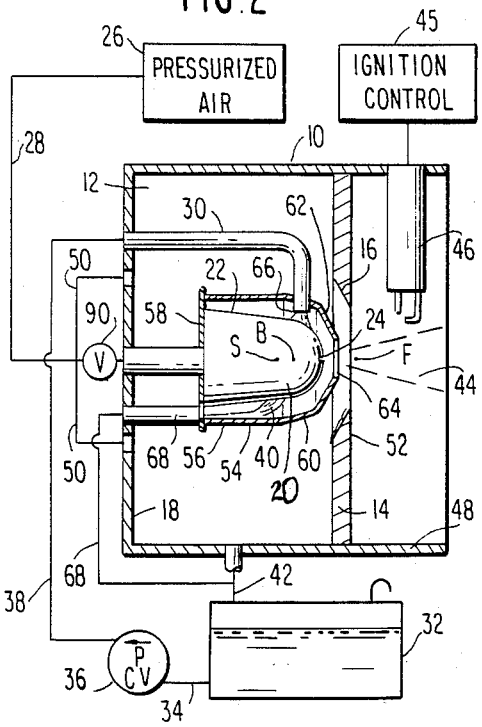
FIG. 2 shows a schematic elevation view, partially in section, of a liquid fuel burner of the basic type illustrated in FIG. 1, which has been improved to operate in accordance with the method of the present invention and to incorporate the apparatus of the present invention.

As previously discussed, FIG. 1 illustrates a prior art liquid fuel burner apparatus which operates in accordance with the Babington principle. In FIG. 2, such an apparatus has been modified in accordance with the present invention. In one embodiment, aperture 24 is positioned axially a distance of about 3.81 to 4.57 mm (0.150 to 0.180 inch) from the exit face 52 of discharge cone 16, rather than 6.35 mm (0.250 inch) as in the prior art system. As a result of this positioning, flame front F moves forward into flame tube 48, as illustrated, which advantageously reduces the potential for burn-back. In general, it is desirable to keep the axial spacing between exit face 52 and aperture 24 to a minimum in order to eliminate wetting of the opening in face 52, such as the surface of discharge cone 16, and thereby reducing the potential for carbonization at that location. With this design it is also possible to eliminate cone 16 entirely so that there is simply a circular opening in wall 14 instead of a conical opening as shown in FIG. 2. Such closer positioning also allows a smaller exit area in wall 14 or in cone 16 than in the prior art system, for air passing through atomizing chamber 12 and into flame tube 48 via either of the types of openings in wall 14 as just described.

To minimize the tendency of the faster flowing air to tear fuel away from the surface of atomizer bulb 20, an enclosing shield 54, according to the invention, is positioned around bulb 20 to protect the thin film of fuel from the effects of the rushing air. The shield also provides protection from radiant heat from flame tube 48, which tends to cause the maximum fuel temperature to drop approximately 20° F. in the embodiment shown in FIGS. 2 and 3 when the atomizing chamber is adequately ventilated. The tip of bulb 20 is spherical and has a center on the axis of the bulb at point B. Shield 54 comprises a cylindrical section 56 extending forward to a vertical plane positioned about 1.52 mm (0.060 inch) behind point B, the axial intersection of this plane with the axis of bulb 20 being designated S. Cylindrical section 56 extends rearwardly about 4.83 mm (0.190 inch) from point S to a plane where both shield 54 and atomizing bulb 20 are closed by a back wall 58. Cylindrical section 56 merges into a spherical portion 60 having its center at S with a radius of about 11.43 mm (0.450 inch). Spherical portion 60 merges into a conical section 62 having its apex positioned at about 11.43 mm (0.450 inch) axially forward of point S and preferably having a cone angle of about 65°. A cone angle in the range of 50° to 80° is also acceptable or conical portion 62 may be eliminated completely in favor of simply continuing the arc of spherical portion 60 to its opening 64 in the tip of shield 54. Section 62 terminates at a preferably circular frontal aperture 64. The exterior surface of conical section 62 and the surface of discharge cone 16 thus define an annular conical orifice through which a portion of the air passing through atomizing chamber 12 must flow to reach flame tube 48. In a typical application where atomizer bulb 20 has a tip with a spherical diameter of about 12.7 mm (0.500 inch), the diameter of the outlet opening of discharge cone 16 is increased from about 14.73 to about 17.27 mm (0.580 to 0.680) inch and the diameter of the inlet opening of discharge cone 16 is increased from 20.83 to 29.2 mm (0.820 to 1.150 inch). The larger diameter of conical section 62 preferably is equal to the diameter of the outlet opening of discharge cone 16. Conical section 62 and the walls of discharge cone 16 may be parallel, if desired. Preferably, the maximum flow velocity is achieved at exit face 52. Preferably, wall 14 is about 3.3 mm (0.130 inch) in thickness and the cone angle of discharge cone 16 is approximately 60°. When a simple opening in wall 14 is utilized instead of cone 16, wall 14 would simply be in the form of a sheet metal fire wall separating atomizing chamber 12 from flame tube 48.

In accordance with the invention, the flow of air through atomizing chamber 12 may be increased to about 50% additional from that which could be tolerated in FIG. 1 without rippling the film of fuel passing over atomizer 22. This increased flow of air helps to cool the fuel in operation but the exit velocity through the opening in wall 14 should not be so high as to unnecessarily compress the angle of conical spray 44, which preferably has an apex angle of approximately 30° at aperture 24. The increased flow of air also reduces the potential for burn-back. However, if conical section 62 is too close to discharge cone 16, the shield has a tendency to discolor or varnish due to the higher temperatures induced by closer proximity to combustion in flame tube 48. In addition, excessively high flow of air may actually rip or suck droplets of raw fuel from the surface of bulb 20 and from stream 40 and carry such droplets through the frontal aperture 64 of shield 54 and on into flame tube 48, where their presence reduces the efficiency of combustion. On the other hand, if conical section 62 is too far from discharge cone 16, the air flow velocity through the annular conical orifice drops off quickly. As a result, there is insufficient cooling of conical surface 62, and the flame front may move too close to exit face 52. Both of these conditions may contribute to an undesirable overheating of conical section 62 and the possibility of varnish build-up.

Frontal aperture 64 is axially aligned with discharge cone 16 and aperture 24. In the illustrated example, aperture 64 has a diameter of about 6.6 mm (0.260 inch) and its plane is positioned approximately 2.03 mm (0.080 inch) in front of aperture 24. With frontal aperture 64 thus positioned, the zone of reduced pressure produced by the jet of air and liquid leaving aperture 24 occurs essentially at aperture 64. As a result, shield 54 is close enough to bulb 20 so that it facilitates, rather than impedes, flow into the zone of reduced pressure by a portion of the air passing through the atomizing chamber. This portion of air is entrained into spray 44 issuing from aperture 24. Because the zone of reduced pressure occurs essentially at aperture 64, substantially no air is drawn back through aperture 64 to satisy the entrainment needs of the jet. The diameter of aperture 64 should be large enough to pass conical spray 44 without wetting the periphery of aperture 64; however, if aperture 64 is too large, rippling of the film of fuel on atomizing bulb 20 will result and some of return stream 40 actually may be sucked out of shield 54, particularly when there is a large volume of air passing through atomizing chamber 12.

Figure 3:
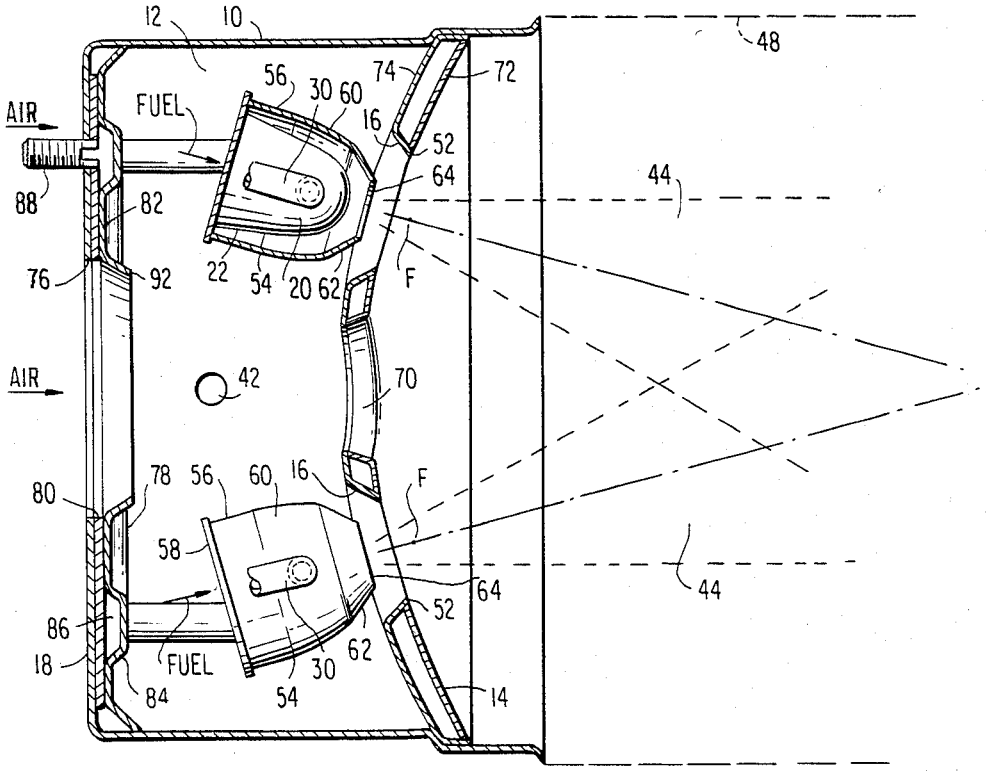
FIG. 3 shows a fragmentary plan view, partially in section, of a liquid fuel burner according to the present invention which incorporates two liquid fuel atomizers which operate in accordance with the method and incorporate the apparatus of the present invention.

At the upper side of shield 54 is provided an opening through which feed tube 30 extends. In the embodiment of FIGS. 2 and 3, tube 30 preferably has an outside diameter of about 3.18 mm (0.125 inch) and an inside diameter of about 2.36 mm (0.093 inch), the tube preferably being flattened at its discharge end to an oval shape transverse to the spray axis, the oval opening having a minor axis length of about 1.4 mm (0.055 inch), as discussed in the copending application Ser. No. 476,453, entitled Improved Liquid Delivery Apparatus and Method for Liquid Fuel Burners and Liquid Atomizers. The center line of tube 30 preferably extends vertically to a location about 2.92 mm (0.115 inch) behind aperture 24. Feed tube 30 is provided with a horizontally extending discharge opening having its rearmost edge 66 positioned about 2.16 mm (0.085 inch) vertically from the upper surface of atomizing bulb 20, in order to prevent the incoming stream of fuel from attaching to the interior surface of shield 54. Return stream 40 preferably leaves the interior of shield 54 via a return conduit 68 which passes through back wall 58 and back wall 18 to join return conduit 42 near pump 32. However, stream 40 also may flow from shield 54 into chamber 12 at back plate 58 or down along back wall 18 into sump 32 via conduit 42. In case any fuel should happen to strike the surface of discharge cone 16, it tends to flow back into atomizing chamber 12 and to return to sump 32 via conduit 42. However, since a liquid fuel atomizer of the type illustrated in FIG. 2 produces very few stray or satellite droplets of fuel, very little liquid flows back into atomizing chamber 12 and the chamber remains essentially dry, thus further reducing the potential for burn-back.

FIG. 3 shows a fragmentary plan view, partially in section, of a prototype embodiment having a pair of atomizer bulbs 20. Front wall 14 has the form of a segment of a sphere with a radius of approximately 69.85 mm (2.75 inch). Two discharge cones 16, set at approximately a 17° angle from the axial centerline of the device are positioned on either side of a central air aperture 70 through which a flow of combustion air passes from atomizing chamber 12 into flame tube 48, indicated in phantom. To further reduce heating of the interior of atomizing chamber 12, wall 14 preferably is hollow in construction, having a front wall 72 and a rear wall 74, as illustrated. However, a single solid wall 14 also may be used to simplify manufacture.

Figure 7:
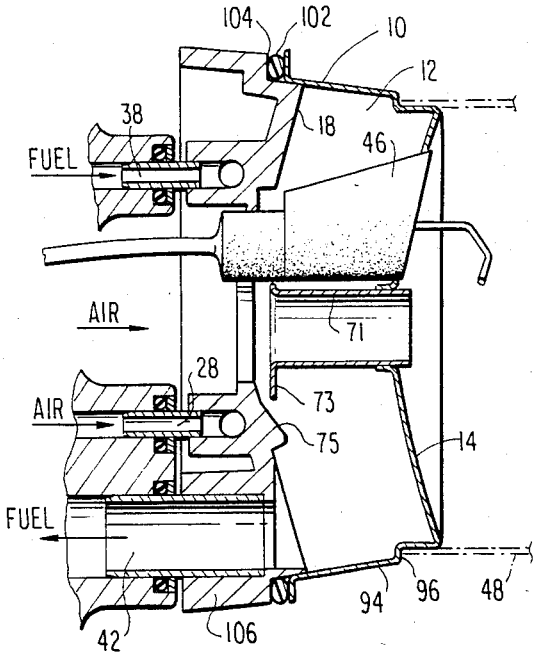
FIG. 7 shows a vertical section taken on line 7—7 of FIG. 4.

Back wall 18 is provided with a centrally located air inlet aperture 76 at least partially surrounded by an annular manifold 78 through which air is directed to the internal plenums of atomizer bulbs 20. Manifold 78 comprises an annular backplate 80 and an annular front plate 82 having a forwardly facing arcuate indentation 84 formed therein. Indentation 84 and backplate 80 thus cooperate to define an annular flow passage 86 therebetween through which air flows to the interior of atomizer bulbs 20. A suitable inlet fitting 88 is provided through back wall 18 to flow passage 86, the fitting being shown rotated upwardly 90° into the plane of view of FIG. 3. That is, in the actual embodiment, fitting 88 is positioned symmetrically relative to the two atomizer bulbs, preferably at the bottom of the housing. As shown in FIG. 2, a valve 90 is provided in conduit 28 for the purpose of controlling the flow of air to the interior of each atomizer bulb. Finally, an inwardly converging conical lip 92 is provided surrounding aperture 76 for the purpose of directing air toward aperture 70 in operation. As will be discussed later and as shown in FIG. 7 for example, a hollow cylindrical conduit 71 may be used to interconnect rear aperature 76 and central air aperture 70. This arrangement allows the airflow through aperture 70 to be controlled independent of the air which enters atomizing chamber 12.

Figure 4:
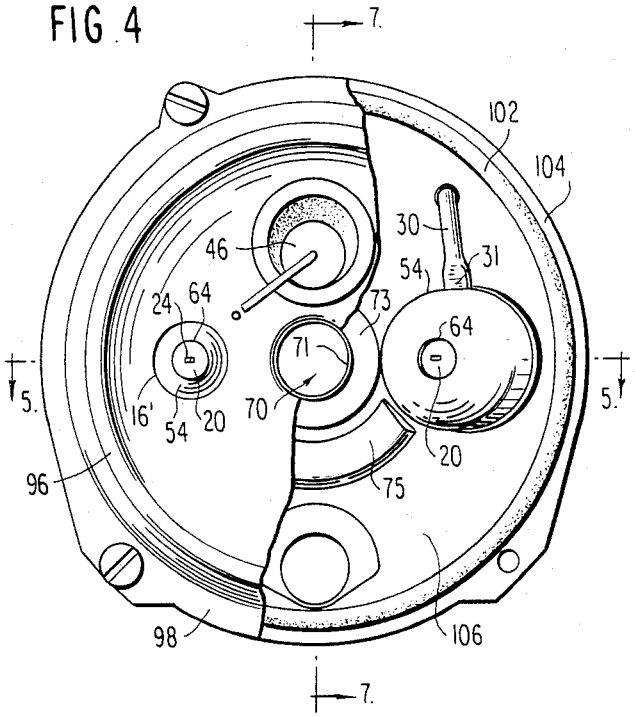
FIG. 4 shows a partially broken away frontal view, as seen from the flame tube, of a liquid fuel burner according to the invention.
Figure 6:
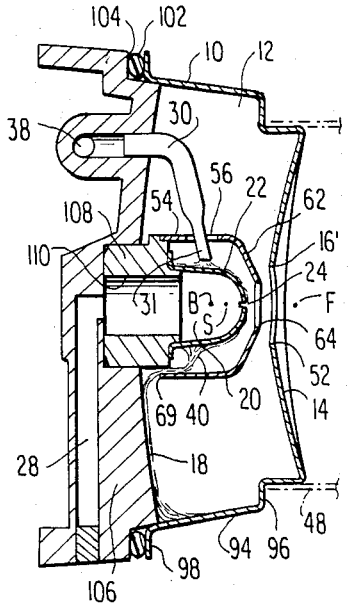
FIG. 6 shows a vertical section taken on line 6—6 of FIG. 5.

Although the position of igniter 46 is not shown in FIG. 3, those skilled in the art will appreciate that the igniter may be positioned at any convenient location to initiate combustion of the two conical sprays 44. In actual practice, igniter 46 extends through wall 14 at a position above aperture 70, as illustrated in FIG. 4.

FIGS. 4 to 7 show a preferred embodiment of a liquid fuel burner in accordance with the invention, which is configured to replace high pressure spray burners now commonly used in domestic furnaces and similar applications. Similar elements of structure have been given the same reference numerals used in FIGS. 1–3. Discharge cones 16 have been replaced by simple circular openings 16' in front wall 14, which itself comprises a rearwardly projecting segment of a sphere formed at the base of a metal cup 94. An intermediate, radially projecting flange 96 on cup 94 engages flame tube 48, as shown in phantom. A rear, radially projecting flange 98 on cup 94 engages an O-ring seal 102 positioned on a peripherally extending flange 104 of a cast and drilled essentially circular, manifold plate 106 which comprises rear wall 18 of atomizing chamber 12.

In this embodiment, aperture 24 is positioned axially a distance of about 4.1 to about 4.3 mm (0.161 to 0.169 inch) from the exit face 52 of opening 16', rather than 6.35 mm (0.250 inch) as in the prior art system. As a result of this positioning, flame front F moves forward into flame tube 48, further reducing the potential for burn-back.

In the embodiment of FIGS. 4 to 7, the tip of bulb 20 is spherical and has a center on the axis of the bulb at point B. Shield 54 comprises a cylindrical section 56 extending forward to a vertical plane positioned about 10.5 mm (0.415 inch) in front of point B, the axial intersection of this plane with the axis of bulb 20 being designated S. Cylindrical section 56 extends rearwardly about 10.2 mm (0.400 inch) from point S to a location where both shield 54 and atomizer bulb 20 are attached to an annular mounting piece 108 supported by manifold plate 106 and provided with a central air conduit 110 communicating with the interior of atomizer bulb 20. Cylindrical section 56 merges into a conical section 62 having its apex positioned about 6.4 mm (0.250 inch) axially forward of point S and preferably having a cone angle of about 65°. A cone angle in the range of 50° to 80° is also acceptable. The exterior surface of conical section 62 and opening 16' define an annular orifice through which a portion of the air passing through atomizing chamber 12 must flow to reach flame tube 48. In a typical application where atomizer bulb 20 has a tip with a spherical diameter of about 12.7 mm (0.500 inch), the diameter of opening 16' is in the range of about 11.8 to about 12.0 mm (0.46 to 0.47 inch). The larger diameter of conical section 62 preferably is about two times larger than the diameter of opening 16' and the diameter of frontal aperture 64 preferably is in the range of about 5.2 to about 5.4 mm (0.205 to 0.213 inch).

The flow of air through atomizing chamber 12 can be increased up to 50% more in the embodiment of FIGS. 4 to 7, compared to 0.56 to 0.7 c.u./m (20 to 25 cfm) for the prior art apparatus of FIG. 1. As in the embodiment of FIGS. 2 and 3, the increased flow of air helps to cool the fuel in operation but should not be so high as to unnecessarily compress the angle of conical spray 44, which preferably has an apex angle of approximately 30° at aperture 24. The increased flow of air also reduces the potential for burn-back. If conical section 62 is too close to opening 16', the shield has a tendency to discolor or varnish due to the higher temperatures induced by closer proximity to combustion in flame tube 48. In addition, excessively high flow of air may actually rip or suck droplets of raw fuel from the surface of bulb 20 and from stream 40 and carry such droplets through the frontal aperture 64 of shield 54 and on into flame tube 48, where their presence reduces the efficiency of combustion. On the other hand, if conical section 62 is too far from opening 16', the air flow velocity through the annular orifice drops off quickly. As a result, there is insufficient cooling of conical surface 62, and the flame front may move too close to exit face 52. Both of these conditions may contribute to an undesirable overheating of conical section 62 and the possibility of varnish build-up.

In the embodiment of FIGS. 4 to 7, the plane of frontal aperature 64 is positioned approximately 1.65 to 1.85 mm (0.065 to 0.073 inch) in front of aperture 24. Once again, the diameter of aperture 64 should be large enough to pass conical spray 44 without wetting the periphery of aperture 64; however, if aperture 64 is too large, rippling of the film of fuel on atomizing bulb 20 will result and some of return stream 40 actually may be sucked out of shield 54, particularly when there is a large volume of air passing through atomizing chamber 12.

In the embodiment of FIGS. 4 to 7, feed tube 30 preferably has an outside diameter of about 2.92 mm (0.125 inch) and an inside diameter of about 2.36 mm (0.093 inch), the discharge end 31 of the feed tube being flattened in the manner previously described. The center line of tube 30 preferably extends at an angle of about 100° to the horizontal, to a location where its leading edge is about 5.3 to about 5.8 mm (0.21 to 0.23 inch) behind aperture 24. As in the case of the embodiment of FIGS. 2 and 3, positioning frontal aperture 64 in this way ensures that the zone of reduced pressure produced by the jet of liquid and air leaving aperture 24 will occur essentially at aperture 64 so that air is not drawn into the shield to satisfy the entrainment needs of the jet. The discharge opening of feed tube 30 is parallel to surface 22 of bulb 20, at a spacing of about 0.58 to about 0.74 mm (0.023 to 0.029 inch) from the upper surface of bulb 20. Return stream 40 leaves the interior of shield 54 via a notch 69 in the underside of shield 54, from which it flows down back wall 18 to return conduit 42 shown in FIG. 7 but not in FIG. 6. In case any fuel should happen to strike the entrance face of opening 16', it tends to flow back into atomizing chamber 12 and to return to sump 32 via conduit 42.

Figure 5:
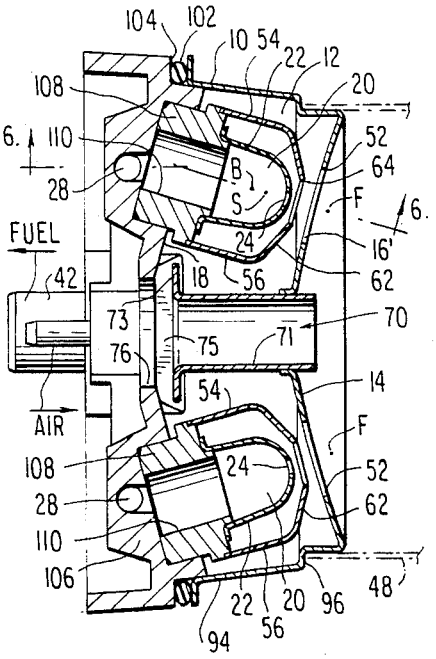
FIG. 5 shows a horizontal section taken on line 5—5 of FIG. 4.

As shown in FIGS. 4 and 5, a pair of atomizing bulbs 20 are provided in this embodiment in which front wall 14 also has the form of a segment of a sphere with a radius of approximately 69.85 mm (2.75 inches). Two discharge openings 16', each set at approximately a 17° angle from the axial centerline of the device, are positioned on either side of a central air aperture 70 through which a flow of air passes from atomizing chamber 12 into flame tube 48. Aperture 70 is defined by a central air tube 71 which is secured at its forward end to front wall 14. At its rearward end, tube 71 comprises a radially extending air deflection flange 73, which radially deflects a portion of the air entering chamber 12 through inlet aperture 76 in manifold plate 106. Tube 71 preferably is from about 23.6 to about 24.0 mm (0.929 to 0.945 inch) in length and flange 73 is spaced from about 4.2 to about 4.4 mm (0.165 to 0.173 inch) from back wall 18. The deflected portion of the air leaves chamber 12 through openings 16'. To minimize the tendency of the deflected air to entrain fuel from the stream flowing to conduit 42, an arcuate, axially extending deflection abutment 75 is provided on back wall 18 below inlet aperture 76 and deflection flange 73, as seen in FIGS. 4, 5 and 7.

Manifold plate 106 comprises cast and drilled passages which define conduit 38 leading to feed tubes 30; and conduits 28, leading to atomizing bulbs 20. To facilitate modular installation and removal of the burner shown in FIGS. 4 to 7, manifold plate 106 comprises bosses on its rear face from which stubs of conduits 28, 38 and 42 extend, as shown in FIGS. 5 and 7. The associated support structure, illustrated fragmentarily in FIG. 7, may comprise matching bosses having appropriate seals for receiving such conduit stubs. As shown in FIGS. 4 and 7, igniter 46 is supported by front wall 14 and manifold plate 106 so that it can be easily inserted and removed. However, the igniter may be positioned at any convenient location to initiate combustion of the two conical sprays 44.

In operation of the liquid fuel burner or liquid atomizer according to the present invention, a flow of liquid is directed through feed tubes 30 and over atomizer bulb 20 until a thin, continuous and free-flowing film of liquid has been established over the entire surface of the bulb. This normally takes only a second or two, after which air flows through conduit 28 and aperture 76 to reach the interiors of atomizing bulbs 20 and atomizing chamber 12 respectively. Conical sprays 44 of atomized fuel are thus established and combustion commences upon actuation of igniter 46. When combustion is no longer desired, valve 90 is closed and igniter 46 is deactivated while flow of fuel through feed tubes 30 and air through atomizing chamber 12 are continued. These continued flows of fuel and air tend to reduce the temperature of the components located within the atomizing chamber, thereby further reducing the potential for burn-back into the atomizing chamber and varnish buildup.

A liquid fuel atomizer constructed in accordance with the illustrated embodiments will produce a variable atomization rate from about 0.5678 to 3.785 liters per hour (0.15 to 1.0 gallons per hour) based on fuel feed rates of about 11.36 to 30.28 liters per hour (3 to 8 gallons per hour) through the two feed tubes. Liquid fuel atomizers configured and operated in accordance with the present invention have been found to exhibit this improved behavior when the cross-sectional area of the discharge aperture 24 is about $10.97\times10^{-4}$ to $12.26\times10^{-4}$ sq.cm ($1.7\times10^{-4}$ to $1.9\times10^{-4}$ square inches); the pressure applied to the interior of atomizer bulb 20 is in the range of about 1.02 to 1.6 bar (15 to 23.5 psi); the total flow rate of air through both atomizing bulbs is in the range of about 0.0056 to 0.007 cu.meter per minute (0.2 to 0.25 cfm) and the liquid fuels have a viscosity range of 2.0 to 10.0 centistokes.

INDUSTRIAL APPLICABILITY

While the present invention has been disclosed as particularly suited for use in liquid fuel burners and liquid atomizers, those skilled in the art will recognize that its teachings also may be followed for other applications of the Babington principle where it is desired to obtain improved control over the flow characteristics of the atomized liquid.

Having described my invention in sufficient detail to enable those skilled in the art to make and use it, I claim:

1. Apparatus for atomizing a liquid, comprising:

an atomizing chamber having a wall with a first opening;

a first source of liquid;

a second source of pressurized gas;

a third source of pressurized gas at a pressure lower than that of said second source;

at least one enclosed plenum having a smooth, convex exterior surface with an aperture opening from said at least one plenum through said surface, said plenum being positioned in said chamber with said aperture facing said first opening;

first means, comprising a feed tube extending into said chamber, for directing a flow of liquid from said first source, through said feed tube and onto said exterior surface, whereby a thin film of liquid is formed on said surface and at said aperture;

second means for directing a flow of pressurized gas from said second source into said at least one plenum and through said aperture to atomize liquid flowing over said aperture and form a jet of gas and liquid droplets, said jet thereby producing a zone of reduced pressure downstream of said aperture;

third means for directing a flow of gas from said third source into said atomizing chamber; and shield means within said atomizing chamber and at least partially surrounding said at least one plenum for protecting said thin film from ambient gas currents in said atomizing chamber, said feed tube extending through said shield means, said shield means being spaced from said exterior surface for permitting free flow of said thin film over said surface and said shield means comprising a second opening downstream of and axially aligned with said aperture and said first opening, through which second opening gas and atomized liquid can flow, said second opening of said shield means being spaced from said aperture at a distance for facilitating flow of gas from said third source to be entrained in said jet of gas and liquid formed at said aperture.

2. Apparatus according to claim 1, wherein said shield means comprises a fourth opening through which liquid not atomized flows from the space between said shield means and said exterior surface.

3. Apparatus according to claim 1, wherein said first opening converges through said wall from a larger diameter closer to said shield means to a smaller diameter further from said shield means; and said shield means converges from a larger diameter spaced from said second opening to a smaller diameter at said second opening, whereby an annular passage is defined between said first opening and said shield means through which a portion of said flow of through which a portion of said flow of gas from said third source must pass.

4. Apparatus according to claim 3, wherein said first opening and said shield means each comprise a conical surface between their respective larger and smaller diameters.

5. Apparatus according to claim 4, wherein said larger diameter of said shield means is equal to said smaller diameter of said discharge opening.

6. Apparatus according to claim 4, wherein the conical surfaces of said shield means and said discharge opening are parallel.

7. Apparatus according to claim 1, wherein said shield means converges from a larger diameter spaced from said second opening to a smaller diameter at said second opening, whereby an annular passage is defined between said discharge opening and said shield means through which a portion of said flow of gas from said third source must pass.

8. Apparatus according to claim 2, wherein said third means for directing comprises a conduit extending through said wall of said atomizing chamber to a point within said chamber and first deflection means operatively associated with said conduit for deflecting a first portion of said flow from said third source into said atomizing chamber while a second portion passes through said conduit.

9. Apparatus according to claim 8, further comprising second deflector means for deflecting said first portion of said flow away from contact with said liquid not atomized.

10. Apparatus according to claim 1, wherein there are two enclosed plenums each having an aperture from which a conical spray issues along an axis, the axes of said sprays being convergent.

11. Apparatus according to claim 2, further comprising:

conduit means extending from said shield means for conveying liquid not atomized from the space between said shield means and said exterior surface to a location outside said atomizing chamber without contacting said flow of pressurized gas from said third source in said atomizing chamber.

12. Apparatus according to claim 11, wherein said first opening converges through said wall from a larger diameter closer to said shield means to a smaller diameter further from said shield means; and said shield means converges from a larger diameter spaced from said second opening to a smaller diameter at said second opening, whereby an annular passage is defined between said first opening and said shield means through which a portion of said flow of gas from said third source must pass.

13. Apparatus according to claim 12, wherein said first opening and said shield means each comprise a conical surface between their respective larger and smaller diameters.

14. Apparatus according to claim 11, wherein said shield means converges from a larger diameter spaced from said second opening to a smaller diameter at said second opening, whereby an annular passage is defined between said first opening and said shield means through which a portion of said flow of gas from said third source must pass.

15. Apparatus according to claim 11, wherein said third means for directing comprises a conduit extending through said wall of said atomizing chamber to a point within said chamber and first deflection means operatively associated with said conduit for deflecting a first portion of said flow from said third source into said atomizing chamber while a second portion passes through said conduit.

16. Apparatus according to claim 11, wherein there are two enclosed plenums each having an aperture from which a conical spray issues along an axis, the axes of said sprays being convergent.

17. Apparatus according to claim 1, wherein said first means for directing a flow of liquid comprises a downwardly extending tube having a discharge opening above said at least one enclosed plenum and within said shield means.

18. An improved apparatus for burning liquid fuel, comprising:

an atomizing chamber having a wall with a first opening;

a first source of liquid fuel;

a second source of pressurized air;

a third source of pressurized air at a pressure lower than that of said second source;

at least one enclosed plenum having a smooth, convex exterior surface with an aperture opening from said at least one plenum through said surface, said plenum being positioned in said chamber with said aperture facing said first opening;

first means, comprising a feed tube extending into said chamber, for directing a flow of fuel from said first source onto said exterior surface, whereby a thin film of fuel is formed on said surface and at said aperture;

second means for directing a flow of pressurized air from said second source into said plenum and through said aperture to atomize fuel flowing over said aperture and form a jet of air and fuel droplets, said jet thereby producing a zone of reduced pressure downstream of said aperture;

third means for directing a flow of gas from said third source into said atomizing chamber;

shield means within said atomizing chamber and at least partially surrounding said at least one enclosed plenum for protecting said thin film from ambient air currents in said atomizing chamber, said feed tube extending through said shield means, said shield means being spaced from said exterior surface for permitting free flow of said thin film over said surface and said shield means comprising a second opening downstream of said axially aligned with said aperture and said first opening, through which air and atomized fuel can flow, said second opening of said shield means being spaced from said aperture at a distance for facilitating flow of air from said third source to be entrained in said jet of air and fuel formed at said aperture;

and means for igniting said atomized fuel.

19. Apparatus according to claim 18, wherein said shield means comprises a fourth opening through which fuel not atomized flows from the space between said shield means and said exterior surface.

20. Apparatus according to claim 18, wherein said first opening converges through said wall from a larger diameter closer to said shield means to a smaller diameter further from said shield means; and said shield means converges from a larger diameter spaced from said second opening to a smaller diameter at said second opening, whereby an annular passage is defined between said first opening and said shield means through which a portion of said flow of air from said third source must pass.

21. Apparatus according to claim 20, wherein said first opening and said shield means each comprise a conical surface between their respective larger and smaller diameters.

22. Apparatus according to claim 21, wherein said larger diameter of said shield means is equal to said smaller diameter of said discharge opening.

23. Apparatus according to claim 18, wherein said first means for directing a flow of fuel comprises a downwardly extending tube having a discharge opening above said at least one enclosed plenum and within said shield means.

24. Apparatus according to claim 18, wherein said shield means converges from a larger diameter spaced from said second opening to a smaller diameter at said second opening, whereby an annular passage is defined between said first opening and said shield means through which a portion of said flow of air from said third source must pass.

25. Apparatus according to claim 19, wherein said third means for directing comprises a conduit extending through said wall of said atomizing chamber to a point within said chamber and first deflection means operatively associated with said conduit for deflecting a first portion of said flow from said third source into said atomizing chamber while a second portion passes through said conduit.

26. Apparatus according to claim 25, further comprising second deflector means for deflecting said first portion of said flow away from contact with said liquid not atomized.

27. Apparatus according to claim 18, wherein there are two enclosed plenums each having an aperture from which a conical spray issues along an axis, the axes of said sprays being convergent.

28. Apparatus according to claim 18, further comprising:

conduit means extending from said shield means for conveying fuel not atomized from the space between said shield means and said exterior surface to a location outside said atomizing chamber without contacting said flow of pressurized air from said third source in said atomizing chamber.

29. Apparatus according to claim 28, wherein said first opening converges through said wall from a larger diameter closer to said shield means to a smaller diameter further from said shield means; and said shield means converges from a larger diameter spaced from said second opening to a smaller diameter at said second opening, whereby an annular passage is defined between said first opening and said shield means through which a portion of said flow of air from said third source must pass.

30. Apparatus according to claim 29, wherein said first opening and said shield means each comprise a conical surface between their respective large and smaller diameters.

31. Apparatus according to claim 28, wherein said shield means converges from a larger diameter spaced from said second opening to a smaller diameter at said second opening, whereby an annular passage is defined between said first opening and said shield means through which a portion of said flow of air from said third source must pass.

32. Apparatus according to claim 28, wherein said third means for directing comprises a conduit extending through said wall of said atomizing chamber to a point within said chamber and first deflection means operatively associated with said conduit for deflecting a first portion of said flow from said third source into said atomizing chamber while a second portion passes through said conduit.

33. Apparatus according to claim 28, wherein there are two enclosed plenums each having an aperture from which a conical spray issues along an axis, the axes of said sprays being convergent.

34. Apparatus according to claim 18, wherein said first means for directing a flow of fuel comprises a downwardly extending tube having a discharge opening above said at least one enclosed plenum and within said shield means.

35. An improved method of atomizing a liquid, comprising the steps of:

providing an atomizing chamber having a wall with a first opening;

providing a first source of liquid to be atomized;

providing a second source of pressurized gas;

providing a third source of pressurized gas at a pressure lower than that of said first source;

providing within said chamber at least one enclosed plenum having a smooth, convex exterior surface with an aperture opening from said at least one plenum through said surface and facing said first opening;

directing a flow of liquid from said first source, through a feed tube extending into said chamber and onto said exterior surface, whereby a thin film of liquid is formed on said surface and at said aperture;

directing a flow of pressurized gas from said second source into said plenum and through said aperture to atomize liquid flowing over said aperture and form a jet of gas and liquid droplets, said jet thereby producing a zone of reduced pressure downstream of said aperture;

directing a flow of gas from said third source into said atomizing chamber;

providing at least a partial shield around the exterior of said at least one plenum and within said atomizing chamber to protect said thin film from ambient gas currents in said atomizing chamber, said feed tube extending through said shield, while permitting free flow of said film over said surface, and providing said shield with a second opening through which atomized liquid and gas can flow; and spacing said second opening of said shield means at a distance from said aperture chosen for facilitating flow of gas from said third source to be entrained in said jet of gas and liquid formed at said aperture.

36. A method according to claim 35, further comprising the step of removing liquid not atomized from the space between said shield and said exterior surface.

37. A method according to claim 35 further comprising the step of removing liquid not atomized from the space between said shield and said exterior surface without permitting said liquid not atomized to contact said flow of pressurized gas from said third source in said atomizing chamber.

38. A method according to claim 36, further comprising the step of deflecting said flow of pressurized gas from said third space away from contact with said liquid not atomized.

39. A method according to claim 35, wherein two of said enclosed plenums are provided, further comprising the step of directing the sprays from said plenums along convergent paths.

40. An improved method for burning a liquid fuel, comprising the steps of:

providing an atomizing chamber having a wall with a first opening;

providing a first source of fuel to be atomized;

providing a second source of pressurized air;

providing a third source of pressurized air at a pressure lower than that of said first source;

providing within said chamber at least one enclosed plenum having a smooth, convex exterior surface with at least one aperture opening from said at least one plenum through said surface and facing said first opening;

directing a flow of fuel from said first source, through a feed tube extending into said chamber and onto said exterior surface, whereby a thin film of fuel is formed on said surface and at said aperture;

directing a flow of pressurized air from said second source into said plenum and through said aperture to atomize fuel flowing over said aperture and form a jet of air and liquid droplets, said jet thereby producing a zone of reduced pressure downstream of said aperture;

directing a flow of air from said third source into said atomizing chamber;

providing at least a partial shield around the exterior of said at least one plenum and within said atomizing chamber to protect said thin film from ambient air currents in said atomizing chamber, said feed tube extending through said shield, while permitting free flow of said film over said surface, and providing said shield with a second opening through which atomized fuel and air can flow;

spacing said second opening of said shield means at a distance from said aperture chosen for facilitating flow of air from said third source to be entrained in said jet of air and fuel formed at said aperture;

and igniting said atomized fuel.

41. A method according to claim 40, further comprising the step of removing fuel not atomized from the space between said shield and said exterior surface.

42. A method according to claim 40, further comprising the step of deflecting said flow of pressurized gas from said third source away from contact with said liquid not atomized.

43. A method according to claim 40, further comprising the step of removing fuel not atomized from the space between said shield and said exterior surface without permitting said fuel not atomized to contact said flow of pressurized air from said third source in said atomizing chamber.

44. A method according to claim 40, further comprising the step of:

terminating said igniting step and said flow of air through said at least one plenum while continuing said flow of air through said atomizing chamber and said flow of fuel onto said exterior surface, whereby said plenum, shield, fuel and atomizing chamber are cooled and the potential for burn-back into said atomizing chamber is reduced following termination of combustion.

45. A method according to claim 40, wherein two of said enclosed plenums are provided, further comprising the step of directing the sprays from said plenums along convergent paths.

46. Apparatus according to claim 1, wherein said second opening of said shield means is essentially at said zone of reduced pressure.

47. Apparatus according to claim 18, wherein said second opening of said shield means is essentially at said zone of reduced pressure.

48. A method according to claim 35, wherein said second opening of said shield means is essentially at said zone of reduced pressure.

49. A method according to claim 41, wherein said second opening of said shield means is essentially at said zone of reduced pressure.

* * * * *